United States Patent [19]

Kiefer

[11] 3,992,738

[45] Nov. 23, 1976

[54] WATER SKI BINDING

[76] Inventor: James E. Kiefer, 2510 Lone Jack Road, Olivenhain, Calif. 92024

[22] Filed: Oct. 16, 1975

[21] Appl. No.: 622,222

[52] U.S. Cl. ..... 9/310 AA
[51] Int. Cl.[2] ..... A63C 15/06
[58] Field of Search ..... 9/310 A, 310 AA, 310 D, 9/310 E; 280/633

[56] References Cited

UNITED STATES PATENTS

| | | | |
|---|---|---|---|
| 2,866,210 | 12/1958 | Romig | 9/310 AA |
| 2,970,325 | 2/1961 | Moline et al. | 9/310 AA |
| 3,102,279 | 9/1963 | Bennett | 9/310 AA |
| 3,127,623 | 4/1964 | Roudebush | 9/310 AA |
| 3,137,014 | 6/1964 | Meucci | 9/310 AA |

*Primary Examiner*—Trygve M. Blix
*Assistant Examiner*—Gregory W. O'Connor
*Attorney, Agent, or Firm*—Robert E. Geauque

[57] ABSTRACT

A water ski binding having a foot piece and a heel piece which is attached to a mounting plate slidable along the water ski, the mounting plate consisting of a support member for the heel piece and separate latch members connected to the support member and having latch teeth which engage ratchet teeth on the guides for the mounting plate, the latching members being located rearwardly of the heel support member and being connected to the rear portion of the support member by springs located at the outside edges of the mounting plate.

11 Claims, 4 Drawing Figures

WATER SKI BINDING

BACKGROUND OF THE INVENTION

Adjustable water ski bindings are utilized to attach water skis to the feet of skiers and consist of a foot piece which is stationary on the water ski and a heel piece which is adjustable lengthwise of the water ski. In order to attach the water ski to the foot, the toe is first inserted into the front vamp or foot piece and then the heel piece is pressed against the heel until a tight fit on the foot is accomplished. The heel piece can be attached to a mounting plate which is slidable in guides attached to the ski on opposite sides of the plate. The mounting plate can carry two latch members having teeth which cooperate with ratchet teeth on the guides and when the teeth are engaged, the heel piece will be locked against rearward movement which would loosen the heel piece. Quick loosening of the heel piece can be accomplished by disengagement of the teeth by movement of the latch members so that the skier is able to quickly remove the ski from his foot in the event of a fall into the water. Present locking mechanisms for the heel piece utilize pawl or latch members and springs which are unnecessarily complicated since either pivots or guide slots are required in the mounting plate for the latch members and separate springs are required for these members. The U.S. Pat. to W. J. Meucci No. 3,137,014 is an example of guide slots cut in the mounting plate for latch or pawl members. The use of pivots connected to the mounting plate for latch or pawl members is illustrated by U.S. Pat. Nos. to H. A. Moline 2,970,325; B Roudebush 3,127,623; and W. W. Bennett 3,102,279. Also, the patent to R. I. Rumig, 2,866,210 requires a separate spring attached to the mounting plate for the latch member. These prior locking mechanisms for ski bindings are unnecessarily expensive and are, under some circumstances, difficult to operate during attachment and removal of the ski from the foot.

SUMMARY OF THE INVENTION

The present invention relates to the heel piece of a water ski binding and utilizes a novel adjusting and locking mechanism for the heel piece. The heel piece is attached to a mounting plate which is slidable longitudinally of the ski between guides on opposite sides of the ski. Latching members are integral with the mounting plate and have teeth which are normally spring biased into engagement with ratchet teeth on the guides. The biasing springs are also integral parts of the mounting plate so that the mounting plate can consist of a single piece molded from a suitable plastic material, such as Delrin, which is an acetal resin marketed by DuPont. Any suitable material can be used for the mounting plate which is wear resistant and has good spring characteristics without being hard and brittle. Since the locking mechanism for the heel piece does not require separate pivot pins or guide slots for the latch members or separate springs as required in prior devices, the mounting plate and locking mechanisms are essentially only one piece. A finger piece is integrally connected with each of the latch members and it is only necessary to squeeze the finger pieces together in order to disengage the latch teeth from the ratchet teeth and permit movement of the heel piece relative to the foot piece. The teeth on the latch members and the ratchet teeth on the guides are shaped to have one side transverse to the guide and another side directed forwardly. When the heel piece is moved forwardly, the latch teeth will skip over the ratchet teeth on the guides without squeezing the latch member. However, since the latch teeth are spring biased against the ratchet teeth, it is necessary to squeeze the latch members to disengage the teeth before the mounting plate can be moved rearwardly. The simple construction enhances the reliability of the locking mechanism since there are fewer parts to break or otherwise fail or to be lost. Ease of manufacturing of the ski binding is brought about by the use of plastics which can be molded and use of a minimum number of parts which reduces the labor time required to assemble the binding.

DESCRIPTION OF THE PREFERRED EMBODIMENT

Figure 1:
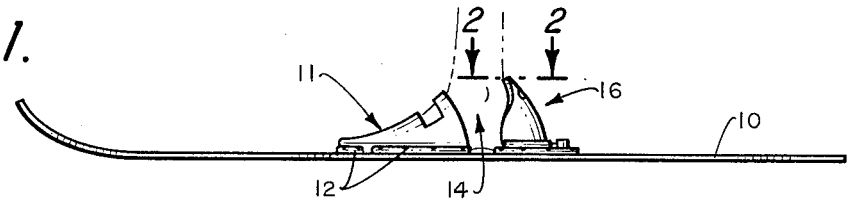
FIG. 1 is a side elevational view of a water ski binding having a foot piece and a heel piece.

The water ski 10 has a body 10*a* constructed of wood covered by a thin layer 10*b* of a suitable smooth plastic. A foot piece 11 is rigidly secured to the ski by a plurality of retainer members 12 which overlie the edges of the foot piece 11 and are attached by screws (not shown) permanently to the water ski 10. In order to apply the water ski to the foot 14 of the skier, the toes are first inserted into the foot piece 11 and heel piece 16 is then moved forward to tightly grip the heel as illustrated in FIG. 1. After the heel piece 16 grips the heel, it is essential that it be held rigidly in this position thereafter until released. Also, a certain amount of movement of the heel piece is required to adjust the ski binding for different sizes of feet 14.

Figure 2:
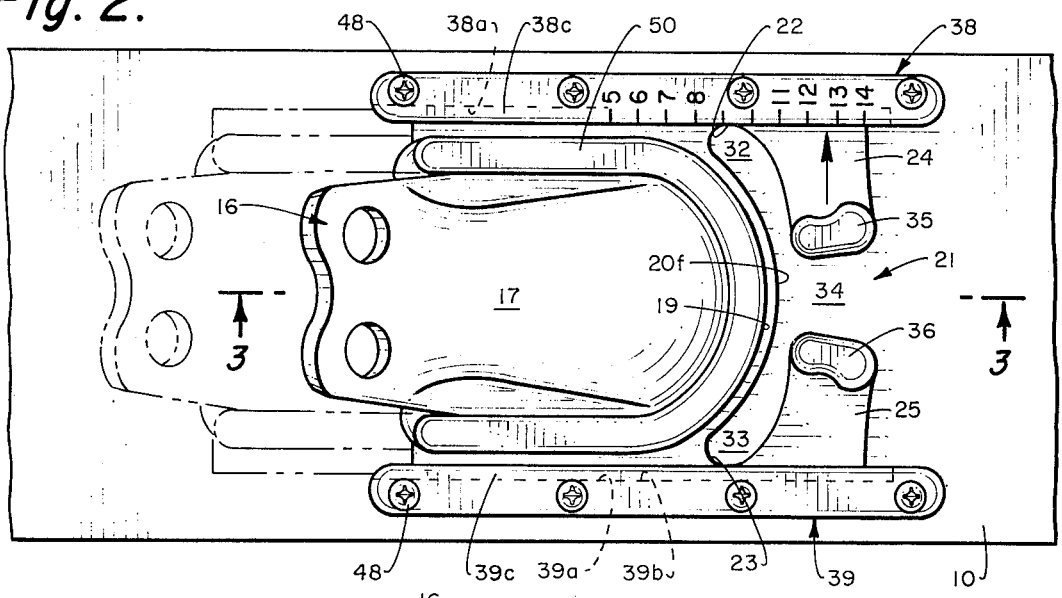
FIG. 2 is a top plan view along line 2—2 of FIG. 1 showing the adjustable heel piece of the present invention.
Figure 3:
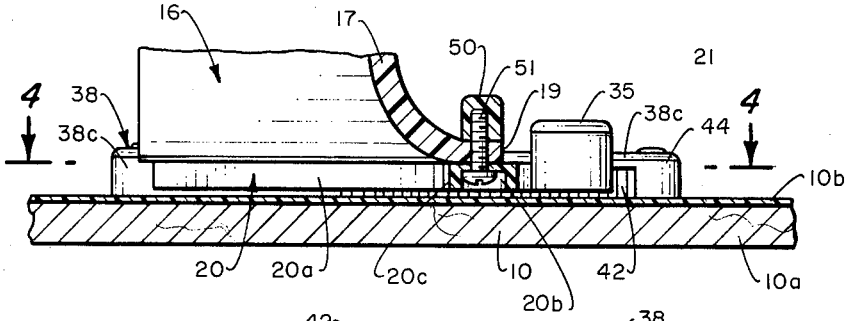
FIG. 3 is a partial transverse vertical section along line 3—3 of FIG. 2 illustrating the heel piece attached to the mounting plate.

The heel piece illustrated in Fig. 2 has a top layer 17 projecting upwardly and forwardly and a bottom U-shaped edge 19 so that a cavity is formed within the heel piece. The heel piece is attached at its bottom edge to a support member 20 which is a part of the complete mounting plate 21. The member 20 has an interior U-shaped side 20*a* formed as a side of U-shaped cavity 20*b* which has legs 20*c* engaging the top plastic ski surface 10*b*. The U-shaped edge 19 of the heel piece is placed over cavity 20*b* and a U-shaped retaining member 50 is then placed over edge 19 and screws 51 are then passed from the cavity into member 50 to firmly secure the heel piece to the support member or section 20. The outer sides 20*d* and 20*e* of support member 20 connect with the spring sections 22 and 23, respectively, at the rearward end of said support member and the spring sections 22 and 23 also connect with latch members 24 and 25, respectively.

Outer side 24*a* of latch member 24 has a plurality of teeth 28 projecting outwardly therefrom and teeth 29 project outwardly from outer side 25*a* of latch member 25. Forward sides 24*b* and 25*b* of latch members 24 and 25, respectively, are spaced rearwardly from the rear curved surface 20*f* of member 20 to form spaces 32 and 33. Also, a space 34 exists between the latch member 24 and 25. The latch members 24 and 25 have finger pieces 35, 36, respectively, extending upwardly therefrom at the inner ends thereof. The spaces 32, 33 and 34 permit the latch members to be squeezed together by inwardly directed force developed by manually squeezing the finger pieces together. The support member 20, the latch members 24 and 25 and springs 22 and 23 comprise the mounting plate 21, and the springs are located at the outer sides of the mounting plate. The latch members 24 and 25 are located completely rearwardly of the support member 20 and are separated from the support member by the springs 22, 23 which are the only connection of the latch members to the support member. All of the components of mounting plate 21 are located in a common plane and can all be integrally formed together by molding in plastic as a single piece. However, it is understood that these parts could be formed separately of different material and then connected together.

Mounting plate 21 is slidably supported on ski surface 10*b* and is guided in a straight longitudinal path along the ski by outside guide members 38 and 39 which have forward vertical guide surface portions 38*a* and 39*a*, respectively, and rear portions 38*b* and 39*b* containing ratchet teeth 42 and 43, respectively. The guide members 38, 39 terminate in enlarged end portions 44 and 45, respectively. Also, guide members 38 and 39 have top flanges 38*c* and 39*c*, respectively, which extend inwardly over the outer sides of mounting plate 21 in order to retain the mounting plate on the surface of the ski after the guides are secured to the ski by screws 48 in position to snugly receive the sides of the mounting plate.

Figure 4:
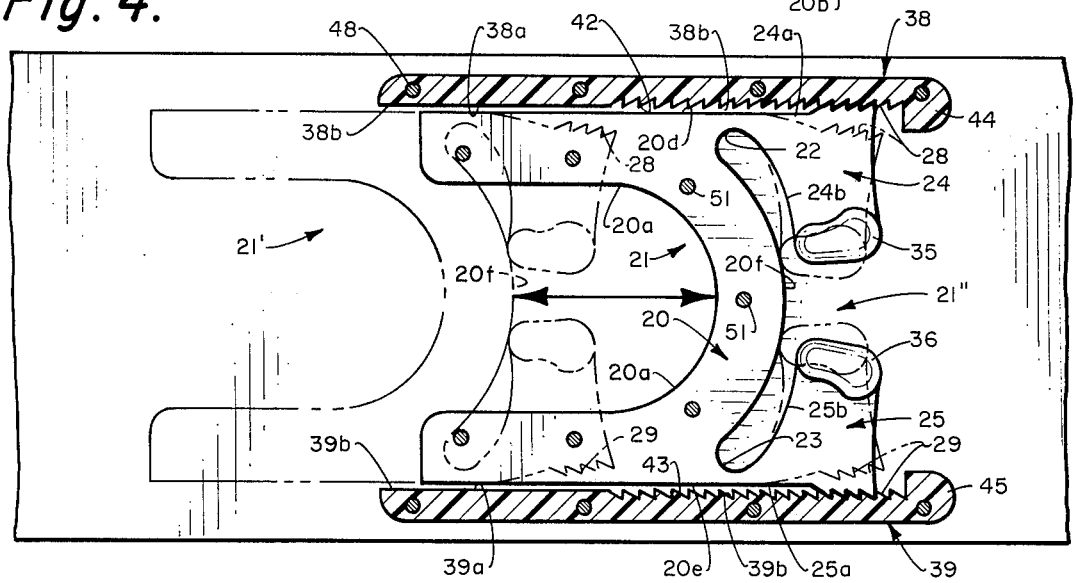
FIG. 4 is a horizontal section along line 4—4 of FIG. 3 illustrating the latch members in locking and releasing positions.

The latch teeth 28 and 29 project outwardly from the plane of sides 24*a* and 25*a* of the latch members and the latch teeth 28, 29 will not pass between sides 38*a* and 39*a* of the guide members without moving inwardly. Referring to FIG. 4, the left phantom line position 21′ of plate 21 shows the plate being inserted between the guide surfaces 28*a* and 39*a* and to accomplish this insertion, the finger pieces 35 and 36 are squeezed together until they engage the curved surface 20f of support member 20. This movement of the latch members moves the latch teeth a sufficient distance away from the guide surfaces to permit the mounting plate to move along guide surfaces 38*a* and 39*a*. This bending movement of the latch surfaces 28 and 29 takes place at the springs 22 and 23. Once the latch teeth pass the surfaces 38*a* and 39*a* and the pressure is removed, the springs move the latch teeth into engagement with the ratchet teeth 42 and 43, as illustrated in the full line position of FIG. 4. With the teeth engagement, the side surfaces 20*d* and 24*a* and side surfaces 20*e* and 25*a* form substantially straight sides for the mounting plate 21.

The plastic molding has a spring quality such that the springs 22 and 23 will move the pawl teeth outwardly until the latch and ratchet teeth engage in the absence of an inward squeezing pressure. As previously stated, once the teeth are engaged, only forward movement and no rearward movement of the mounting plate can take place because of the shape of the teeth. When it is desired to move the mounting plate rearwardly to adjust the heel piece or remove the ski, the latch members are again squeezed together until the finger pieces 35 and 36 engage surface 20*f*, as illustrated in the right phantom position 21″ of mounting plate 21. This movement disengages the latch teeth from the ratchet teeth and permits the mounting plate to move rearwardly until the latch teeth encounter stops 44 and 45. Thereafter, the plate 21 cannot be moved any further rearwardly.

It is apparent that the invention provides a heel piece assembly which requires no slots or pivots or separate springs for the latch members since the latch members are connected to the heel piece support member or section by spring members and all of these sections can be integrally molded from plastic into one piece so that there are no separate parts to break or lose. The mounting plate is easily assembled into the guide members as previously described by moving the latch members inwardly as the plate is introduced between the guide surfaces. The cost of the ski binding is minimum because of the manner of production of the mounting plate and the manner of assembly. Any material, such as metal or plastic, can be used for construction of the mounting plate, either as separate members, or as integral parts of a single piece. When a plastic material is used, the thickness and resiliency of the spring sections must be such as to move the latch and ratchet teeth together.

What is claimed is:

1. In a water ski binding having a foot piece rigidly fixed to the water ski and a heel piece longitudinally movable on said water ski into position to grip the heel of the wearer comprising:

a mounting plate for said heel piece;

a pair of guide means secured to said water ski on opposite sides of said mounting plate for quiding said mounting plate and heel piece for movement along said ski;

each of said guide means comprising an upright guide surface located opposite one outer side of said mounting plate;

a plurality of ratchet teeth cut into one portion of each of said guide surfaces;

said mounting plate comprising a support member attached to said heel piece, a pair of latch members located rearward of said support member and spring means connecting each of said latch members to the rear of said support member, a plurality of latch teeth extending from the outer side of each of said latch members, said latch teeth normally engaging a part of said ratchet teeth after said heel piece is positioned, said latch and ratchet teeth being shaped to prevent rearward movement of said mounting plate when engaged;

each of said spring means being deformed by an inwardly directed force on said latch member attached thereto to permit said latch member to move inwardly and disengage said latch teeth from said ratchet teeth thereby permitting rearward movement of said mounting plate for adjustment or removal of the ski.

2. In a water ski binding as defined in claim 1;

said support member, said latch members and said spring means being integrally formed from the same material to form said mounting plate, each of said spring means comprising a thin portion of said material connecting said support member to a said latch members.

3. In a water ski binding as defined in claim 2;

said outer sides of said mounting plate being normally substantially straight, the outer sides of said support and latch members being portions of said mounting plate sides.

4. In a water ski binding as defined in claim 2;

said material comprising one piece of plastic material having sufficient ductility to permit bending of said thin spring portions.

5. In a water ski binding as defined in claim 4;

said plastic material being Delrin.

6. In a water ski binding as defined in claim 1;

each of said latch members having finger pieces for simultaneously applying an inwardly directed force on each latch member by squeezing said pieces together.

7. In a water ski binding as defined in claim 1;

said latch members being normally spaced rearwardly from said support member and from each other and being moved toward said support member by deforming said spring means, the engagement of said latch members with said support members determining the maximum amount of movement of said latch member and maximum deformation of said spring means.

8. In a water ski binding as defined in claim 1;

said ratchet teeth being located in rear portions of said guide surfaces, the forward portions of said guide surfaces being smooth for slidably receiving portions of said mounting plate outer sides while said latch members are opposite said ratchet teeth.

9. In a water ski binding as defined in claim 7;

said spring means being deformable sufficiently to permit movement of said latch teeth past said forward portions of said guide surfaces and into position opposite said ratchet teeth in said rear portions.

10. In a water ski binding as defined in claim 9;

each of said guide means having a stop at the rear end for preventing said mounting plate from moving rearwardly out of said guide means.

11. In a water ski binding as defined in claim 1;

said support member, said latch members and said spring means being located in the same plane.

* * * * *